US008084675B1

(12) United States Patent
Covert

(10) Patent No.: US 8,084,675 B1
(45) Date of Patent: Dec. 27, 2011

(54) MULTIFUNCTION GUITAR STAND

(76) Inventor: John Covert, Vienna, VA (US)

( * ) Notice: Subject to any disclaimer, the term of this patent is extended or adjusted under 35 U.S.C. 154(b) by 0 days.

(21) Appl. No.: 12/660,830

(22) Filed: Mar. 5, 2010

Related U.S. Application Data

(60) Provisional application No. 61/209,967, filed on Mar. 13, 2009.

(51) Int. Cl.
*G10D 3/18* (2006.01)

(52) U.S. Cl. ..... 84/327; 211/85.6; 211/85.7; 211/87.01

(58) Field of Classification Search ..... 84/327; 211/85.6, 85.7, 87.01
See application file for complete search history.

(56) References Cited

U.S. PATENT DOCUMENTS

| | | | | | |
|---|---|---|---|---|---|
| 2,058,184 | A | * | 10/1936 | Sherrard | 211/85.6 |
| 2,070,507 | A | * | 2/1937 | Bishop | 312/290 |
| 2,455,821 | A | * | 12/1948 | Conrad | 211/85.6 |
| D162,207 | S | * | 2/1951 | Mettenleiter | D6/467 |
| 3,346,310 | A | * | 10/1967 | Diack | 312/140 |
| D249,425 | S | * | 9/1978 | Jones | D6/462 |
| D249,618 | S | * | 9/1978 | Oxenhandler | D6/431 |
| 4,147,254 | A | * | 4/1979 | Bruce | 206/314 |
| D252,303 | S | * | 7/1979 | Persky | D6/462 |
| 4,205,818 | A | * | 6/1980 | Lawler | 248/460 |
| D289,585 | S | * | 5/1987 | Lord | D6/414 |
| D312,016 | S | * | 11/1990 | Montgomery | D6/552 |
| 5,085,327 | A | * | 2/1992 | Mercer et al. | 211/85.7 |
| 5,149,901 | A | * | 9/1992 | Boor et al. | 84/327 |
| D343,309 | S | * | 1/1994 | vonBatsch | D6/467 |
| 5,381,717 | A | | 1/1995 | Brokaw | |
| D358,280 | S | * | 5/1995 | LaFontaine | D6/467 |
| D365,705 | S | * | 1/1996 | Deeley | D6/467 |
| 5,558,416 | A | * | 9/1996 | Dumitru | 312/139 |
| D380,637 | S | * | 7/1997 | Funk | D6/552 |
| D382,158 | S | * | 8/1997 | Allendorph | D6/552 |
| 5,657,883 | A | * | 8/1997 | Badia | 211/70.8 |
| D394,291 | S | * | 5/1998 | Beltran et al. | D6/552 |
| D429,936 | S | * | 8/2000 | McCormick et al. | D6/552 |
| 6,179,135 | B1 | * | 1/2001 | Simpson | 211/85.6 |
| 6,296,213 | B1 | * | 10/2001 | Law et al. | 248/166 |
| D464,215 | S | * | 10/2002 | Patchen | D6/467 |
| 6,462,260 | B2 | | 10/2002 | Fediakov | |
| D466,331 | S | * | 12/2002 | Chang | D6/411 |
| D473,991 | S | * | 4/2003 | Moon et al. | D34/21 |
| 6,540,182 | B1 | * | 4/2003 | Wilfer | 248/121 |
| 6,588,715 | B2 | * | 7/2003 | Wilfer | 248/121 |
| 6,685,283 | B2 | * | 2/2004 | Gembar et al. | 312/114 |
| 6,800,798 | B2 | * | 10/2004 | Hsieh | 84/327 |
| 6,959,810 | B2 | * | 11/2005 | Neilson | 206/314 |
| 7,090,313 | B1 | * | 8/2006 | McMurray | 312/138.1 |
| D530,053 | S | * | 10/2006 | Bothun et al. | D34/17 |
| D530,115 | S | * | 10/2006 | Maitland-Smith | D6/467 |
| 7,150,361 | B2 | * | 12/2006 | Calleja | 211/49.1 |
| 7,188,737 | B2 | * | 3/2007 | McCormick et al. | 211/68 |
| D553,874 | S | * | 10/2007 | Orlando | D6/411 |
| D555,960 | S | * | 11/2007 | Pena | D6/552 |

(Continued)

*Primary Examiner* — Elvin G Enad
*Assistant Examiner* — Robert W Horn
(74) *Attorney, Agent, or Firm* — Patent & Trademark Services, Inc.; Joseph H. McGlynn

(57) ABSTRACT

A guitar stand having supports for holding a plurality of guitars in an upright position. The stand also has a lid secured to the top of the stand which will pivot from an open to a closed position. The stand can also have a second lid above the first lid secured to the top of the stand which will pivot from an open to a closed position.

15 Claims, 4 Drawing Sheets

U.S. PATENT DOCUMENTS

D567,539 S * 4/2008 Teachey et al. ..... D6/449
D572,064 S * 7/2008 Mower et al. ..... D6/553
7,464,910 B1 * 12/2008 St. Germain et al. ..... 248/301
7,484,701 B2 * 2/2009 Hsieh ..... 248/339
D608,945 S * 1/2010 Coleman et al. ..... D28/9
7,772,471 B2 * 8/2010 Bustamante ..... 84/327
7,775,491 B1 * 8/2010 Samu ..... 248/215
2006/0032359 A1 * 2/2006 Smith ..... 84/327
2007/0039446 A1 * 2/2007 Samu ..... 84/327
2010/0307996 A1 * 12/2010 Kahn ..... 211/85.7

* cited by examiner

MULTIFUNCTION GUITAR STAND

Applicant claims priority for Provisional application Ser. No. 61/209,967, filed Mar. 13, 2009.

BACKGROUND OF THE INVENTION

This invention relates, in general, to stands, and, in particular, to a multifunction stand for guitars

DESCRIPTION OF THE PRIOR ART

In the prior art various types of devices have been proposed. For example, U.S. Pat. No. 6,462,260 to Fedinkov discloses a guitar case with a folding top that can be moved into two positions.

U.S. Pat. No. 5,381,717 to Brokaw discloses a table with a foam cushion for receiving a guitar.

U.S. Pat. No. 2,058,184 to Sherrard discloses a guitar stand with supports for holding a plurality of guitars.

SUMMARY OF THE INVENTION

The present invention is directed to a guitar stand having supports for holding a plurality of guitars and/or guitar cases in an upright position. The stand also has a lid secured to the top of the stand which will pivot from an open to a closed position. The stand can also have a second lid above the first lid secured to the top of the stand which will pivot from an open to a closed position.

It is an object of the present invention to provide a new and improved guitar stand which will hold guitars and/or guitar cases in a vertical position.

It is an object of the present invention to provide a new and improved guitar stand which has a surface for supporting a guitar in a horizontal position.

It is an object of the present invention to provide a new and improved guitar stand which has a pivoting work surface so a guitar can be worked on and in addition to the ability to support guitars and/or guitar cases.

These and other objects and advantages of the present invention will be fully apparent from the following description, when taken in connection with the annexed drawings.

DESCRIPTION OF THE PREFERRED EMBODIMENT

The preferred embodiment herein described is not intended to be exhaustive or to limit the invention to the precise form disclosed. It is chosen and described to best explain the invention so that others, skilled in the art to which the invention pertains, might utilize its teachings.

Figure 1:
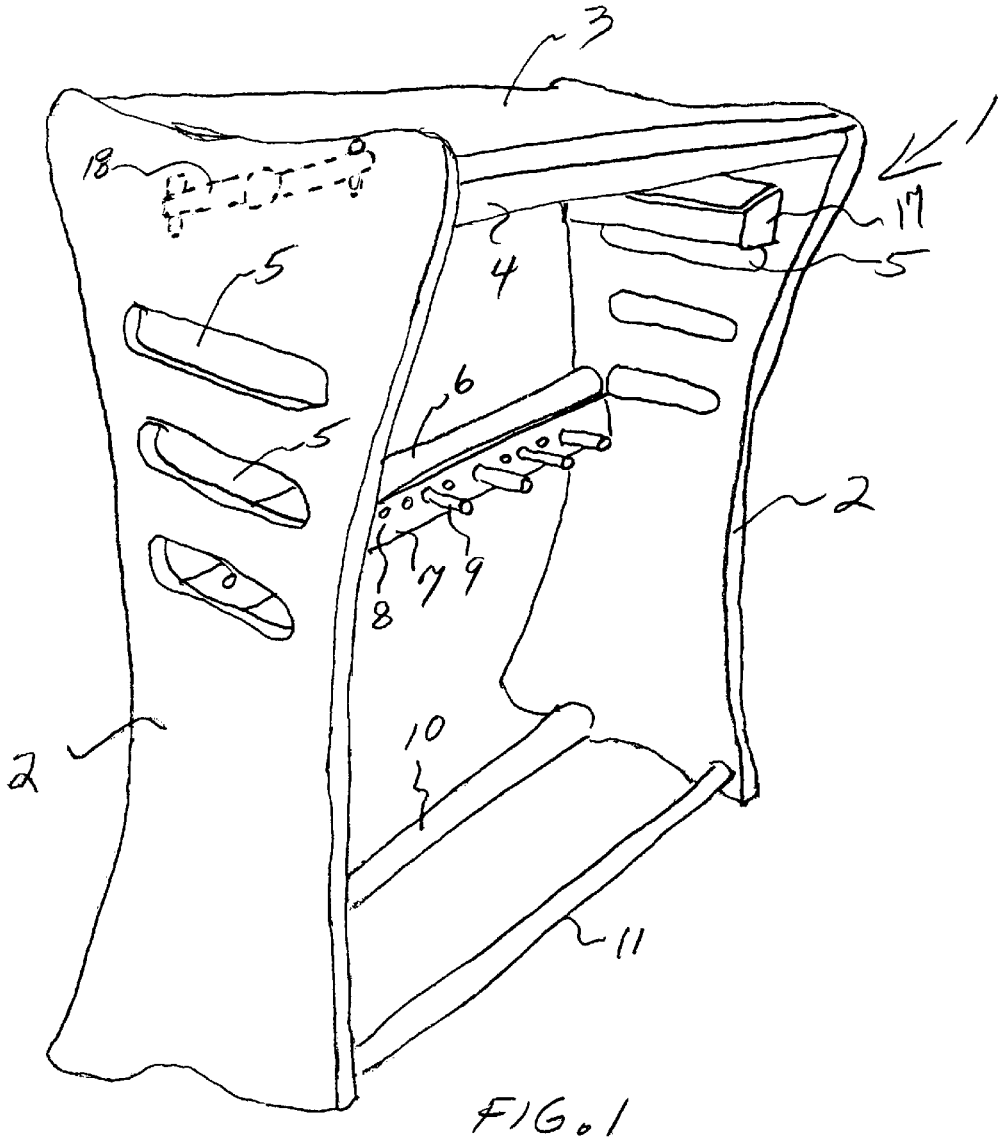
FIG. 1 is a perspective view of the present invention.
Figure 2:
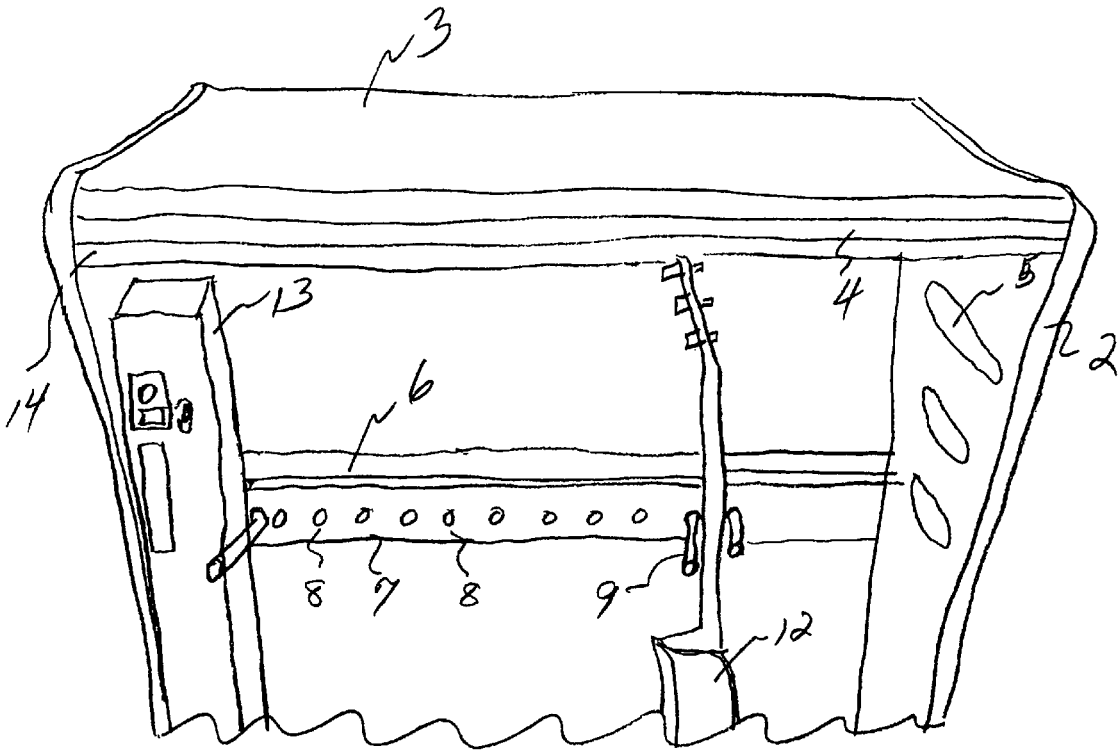
FIG. 2 is a perspective view of the present invention showing it holding a guitar and a guitar case.

Referring now to the drawings in greater detail, FIGS. 1 and 2 show a perspective view of the present invention 1. The stand has a pair of side supports 2. The side supports have a plurality of apertures 5 placed vertically along the length of the side supports which can be used as handles to move the stand if so desired. A plurality of stabilizer bars 6, 7, 10 and 11 are positioned between and secured to the two side supports 2 by any conventional means. The bars 6, 7, 10 and 11 support and stabilize the two sides as well as provide support for contained guitars 12 and/or cases 13 (see FIG. 2). Bars 7, 10 and 11 are positioned appropriately and cushioned in order to safely and properly support the contours of the case or guitar. This will also help the guitar or case remain secure in the stand.

The stabilizer bar 7 has a plurality of apertures 8 therein. Pegs 9 are removably supported in the apertures 8. The pegs can be moved to various apertures 8 to accommodate different widths of guitars or guitar cases (See FIG. 2). The number of apertures 8 and pegs 9 are not critical and can be varied at the whim of the user. A removable accessory bin 17 is secured to the inside of at least one of the sides 2, by any conventional means, to hold various guitar supplies (such as cleaning supplies, guitar strings, picks, etc, or to hold tools that can be used to repair and maintain the guitars). A pair of lids 3, 4 are pivotably secured to the upper portions of the sides 2.

Figure 3:
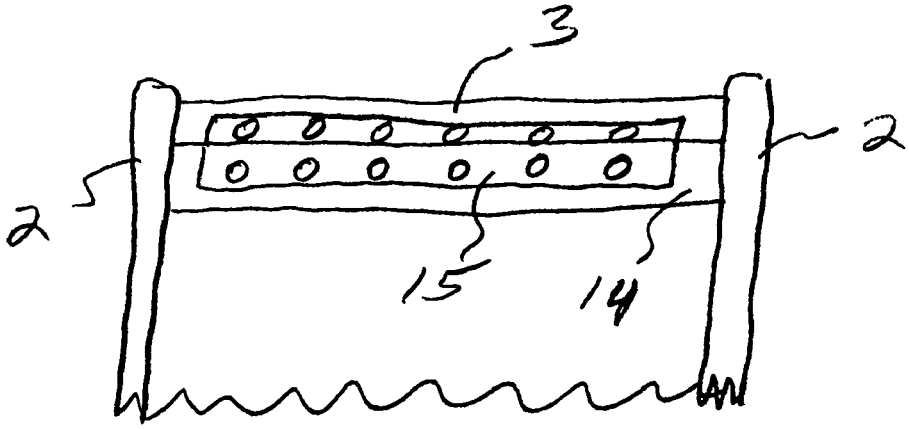
FIG. 3 is a back view of the present invention showing the hinge for holding the upper lid.

FIG. 3 shows the upper lid 3 secured to the lid support 14 (See also FIG. 2) by a conventional piano hinge 15 and can be locked in an upright position by a conventional locking lid stay 18. The stay will be secured to the underside of lid 3 and to the upright 2 as shown in dotted lines in FIG. 1. The lid support 14 extends between the two sides 2 and can be attached to the sides in any conventional manner. The hinge 15 is attached to the back of the lid 3 and to the back of the lid support 14. Lid 3 can be moved from a first or closed position (shown in FIG. 6) to a second or opened position (shown in FIG. 5).

Figure 4:
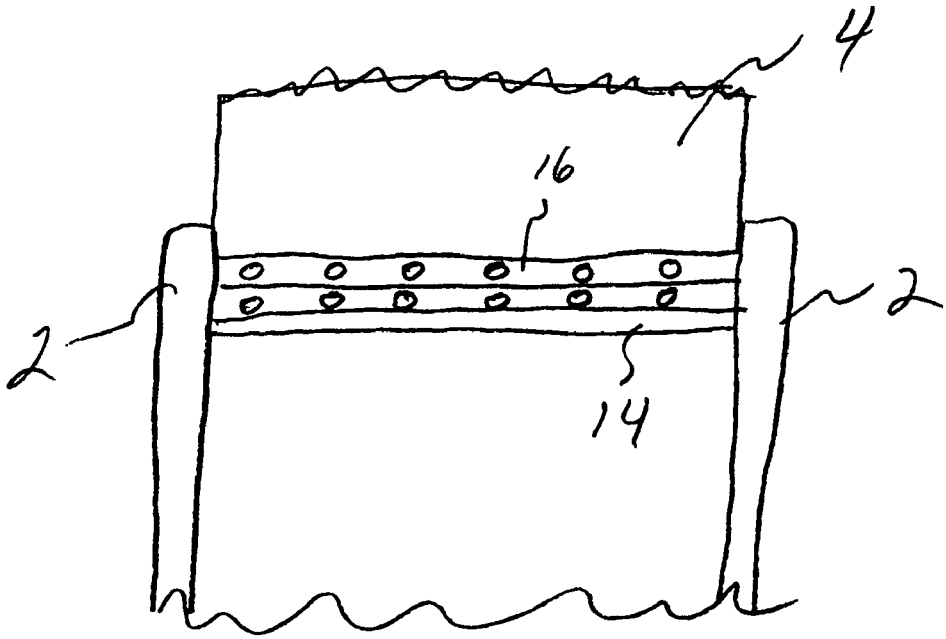
FIG. 4 is a front view of the present invention showing the hinge for holding the lower lid.
Figure 5:
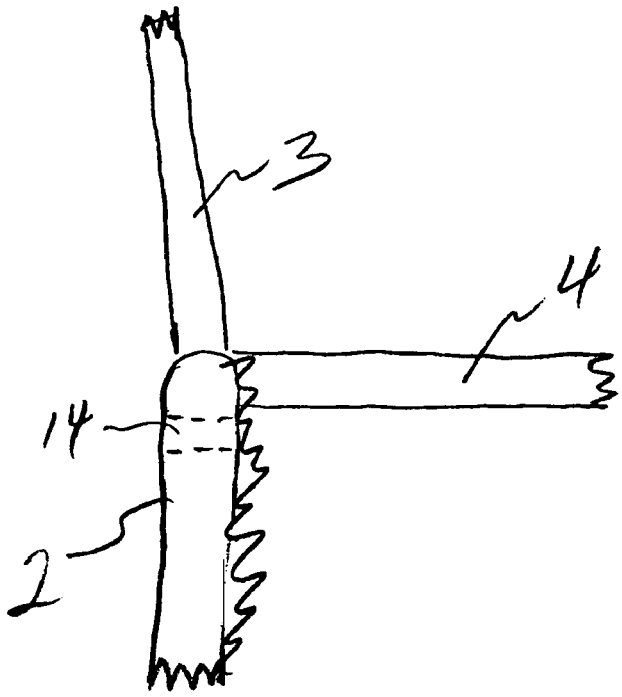
FIG. 5 is a side view of the present invention showing the upper lid opened and the lower lid closed.
Figure 6:
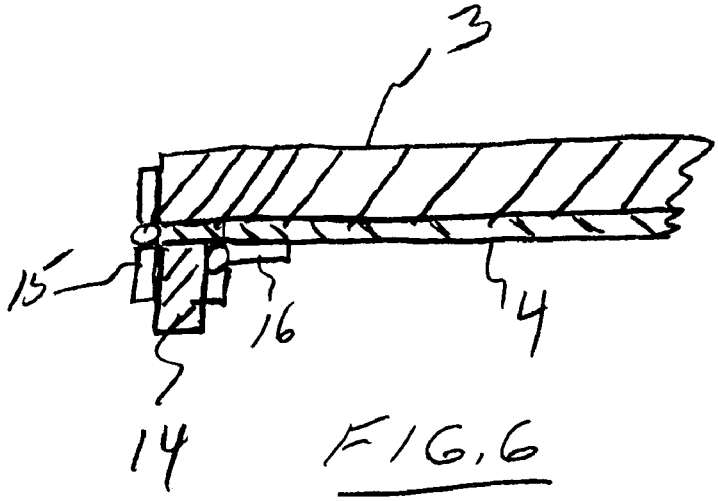
FIG. 6 is a side view of the present invention showing the upper lid and the lower lid closed.

FIG. 4 shows the lower lid 4 secured to the lid support 14 by a conventional piano hinge 16 as seen from the front of the stand. The hinge 16 is attached to the underside of the lid 4 and to the front of the lid support 14. FIG. 5 shows the lids of the present invention from the side with a portion of the side support 2 removed for clarity. The lid 3 is shown in the up or opened and locked position and the lower lid 4 is shown in the down or closed position. FIG. 6 shows the lids in the down position and, also shows the relative positions of the hinges 15, 16 with respect to the lids and the lid support 14. The side support 2 has been removed from FIG. 6 for clarity. The lower lid 4 can also be moved from a first or down position (shown in FIGS. 5 and 6) to a second or up position (shown in FIG. 4). A user could move the lids to their up positions to more easily get at the guitars or cases in the stand.

The upper lid 3 is preferably made from a hard material to protect any guitars or guitar cases which may be stored in the stand. The lower lid 4 is preferably made with a soft material or a soft cover for the top of the lid. This will allow a user to raise the upper lid 3 to the up position (see FIG. 5) place a guitar on the soft lower lid 4 to work on the guitar. The soft surface of the lower lid will protect the guitar while it is being worked on. As an alternative, the stand can be made with only one lid either a hard lid with a soft surface added such as lid 3 or a soft lid such as lid 4.

Although the Multifunction Guitar Stand and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A multifunctional guitar stand comprising:

a pair of upright supports, said pair of upright supports having a top, a bottom, a front, a back, and sides extending from said front to said back, and said sides having an inside surface and an outside surface, stabilizer means for engaging and stabilizing said pair of upright supports, at least one lid attached adjacent said top of said pair of upright supports, and wherein a lid support is secured adjacent said top of said pair of upright supports, and said lid support having means for moving said at least one lid from a first position to a second position, and wherein when said at least one lid is in said first position it is closely adjacent said top of said pair of upright supports, and when said at least one lid is in said second position it is remote from said top of said pair of upright supports.

2. The multifunctional guitar stand as claimed in claim 1, wherein said stabilizer means comprises a pair of bars attached adjacent to said bottom of said upright supports.

3. The multifunctional guitar stand as claimed in claim 1, wherein said stabilizer means comprises a bar attached between said bottom of said upright supports and said top of said upright supports.

4. The multifunctional guitar stand as claimed in claim 3, wherein said bar attached between said bottom of said upright supports and said top of said upright supports has a plurality of apertures positioned therein.

5. The multifunctional guitar stand as claimed in claim 4, wherein said apertures have pegs positioned in at least some of said apertures.

6. The multifunctional guitar stand as claimed in claim 5, wherein said pegs are removably positioned in at least some of said apertures.

7. The multifunctional guitar stand as claimed in claim 1, wherein a stay means is positioned between one of said pair of upright supports and said at least one lid for holding said at least one lid in said second position.

8. The multifunctional guitar stand as claimed in claim 1, wherein a lid support is attached between said upright supports adjacent said back of said upright supports, and said at least one lid is attached to said lid support.

9. The multifunctional guitar stand as claimed in claim 8, wherein said lid support has an inside surface adjacent said front of said upright supports and an outside surface remote from said front of said upright supports, and means for attaching said at least one lid to said lid support, said means for attaching said at least one lid having a first portion and a second portion, said first portion being attached to said at least one lid, and said second portion being attached to said outside surface.

10. A multifunctional guitar stand comprising:

a pair of upright supports, said pair of upright supports having a top, a bottom, a front, a back, and sides extending from said front to said back, and said sides having an inside surface and an outside surface, stabilizer means for engaging and stabilizing said pair of upright supports, at least two lids attached adjacent said top of said pair of upright supports, and wherein a lid support is attached between said upright supports adjacent said back of said upright supports, and said at least two lids are attached to said lid support, and wherein said lid support has an inside surface adjacent said front of said upright supports and an outside surface remote from said front of said upright supports, and means for attaching one of said at least two lids to said lid support, said means for attaching one of said at least two lids having a first portion and a second portion, said first portion being attached to one of said at least two lids, and said second portion being attached to said outside surface, and wherein one of said at least two lids overlies another of said at least two lids, and wherein said one of said at least two lids is made from a material that is harder than the material that said another of said at least two lids is made from.

11. The multifunctional guitar stand as claimed in claim 10, wherein said stand comprises:

means for attaching another of said at least two lids to said lid support, said means for attaching said another of said at least two lids having a first portion and a second portion, said first portion being attached to said another of said at least two lids, and said second portion being attached to said inside surface.

12. The multifunctional guitar stand as claimed in claim 10, wherein said stabilizer means comprises a bar attached between said bottom of said upright supports and said top of said upright supports.

13. The multifunctional guitar stand as claimed in claim 10, wherein said bar attached between said bottom of said upright supports and said top of said upright supports has a plurality of apertures positioned therein.

14. The multifunctional guitar stand as claimed in claim 13, wherein said apertures have pegs positioned in at least some of said apertures.

15. The multifunctional guitar stand as claimed in claim 14, wherein said pegs are removably positioned in at least some of said apertures.

* * * * *